US010319506B2

(12) United States Patent
Tomonari et al.

(10) Patent No.: US 10,319,506 B2
(45) Date of Patent: Jun. 11, 2019

(54) COIL COMPONENT

(71) Applicant: TDK Corporation, Tokyo (JP)

(72) Inventors: Toshio Tomonari, Tokyo (JP); Sachiko Takano, Tokyo (JP); Shigeki Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 22 days.

(21) Appl. No.: 15/590,341

(22) Filed: May 9, 2017

(65) Prior Publication Data

US 2017/0330669 A1 Nov. 16, 2017

(30) Foreign Application Priority Data

May 11, 2016 (JP) ..... 2016-094968

(51) Int. Cl.

| | |
|---|---|
| ***H01F 27/36*** | (2006.01) |
| ***H01F 5/00*** | (2006.01) |
| ***H01F 17/00*** | (2006.01) |
| ***H01F 10/26*** | (2006.01) |
| ***H01F 27/29*** | (2006.01) |
| ***H01F 17/04*** | (2006.01) |
| *H01F 27/28* | (2006.01) |
| *H01F 3/10* | (2006.01) |

(52) U.S. Cl.

CPC ..... *H01F 17/0013* (2013.01); *H01F 5/003* (2013.01); *H01F 10/26* (2013.01); *H01F 17/04* (2013.01); *H01F 27/292* (2013.01); *H01F 27/365* (2013.01); *H01F 2003/106* (2013.01); *H01F 2017/008* (2013.01); *H01F 2017/0053* (2013.01); *H01F 2017/0066* (2013.01); *H01F 2017/0073* (2013.01); *H01F 2027/2809* (2013.01)

(58) Field of Classification Search

CPC ..... H01F 5/003; H01F 10/26; H01F 17/0013; H01F 17/04; H01F 2017/292; H01F 2017/365; H01F 2017/2804; H01F 2017/36; H01F 2027/2809; H01F 2027/348; H01F 2027/346; H01F 2003/106

USPC ..... 336/200, 223, 233, 84 M

See application file for complete search history.

(56) References Cited

U.S. PATENT DOCUMENTS

| | | | | |
|---|---|---|---|---|
| 2015/0187487 | A1* | 7/2015 | Park | H01F 17/0013 336/192 |
| 2016/0172098 | A1* | 6/2016 | Jeong | H01F 17/0013 336/90 |
| 2017/0221622 | A1* | 8/2017 | Park | H01F 27/22 |
| 2017/0256353 | A1* | 9/2017 | Park | C08K 3/28 |

FOREIGN PATENT DOCUMENTS

| | | |
|---|---|---|
| JP | H02-067809 | 5/1990 |
| JP | 2013-045848 A | 3/2013 |

* cited by examiner

*Primary Examiner* — Mang Tin Bik Lian

(74) *Attorney, Agent, or Firm* — Young Law Firm, P.C.

(57) ABSTRACT

Disclosed herein is a coil component that includes an element body made of a first magnetic material, a coil conductor embedded in the element body, and first and second magnetic films made of a second magnetic material having higher permeability than that of the first magnetic material. The element body has an upper surface crossing a coil axis of the coil conductor and first and second side surfaces extending substantially parallel to the coil axis. The first magnetic film is formed on the upper surface and first side surface of the element body, and the second magnetic film is formed on the upper surface and second side surface of the element body.

19 Claims, 5 Drawing Sheets

COIL COMPONENT

BACKGROUND OF THE INVENTION

Field of the Invention

The present invention relates to a coil component and, more particularly, to a coil component obtained by embedding a coil conductor in an element body made of a magnetic material.

Description of Related Art

There is widely known a coil component obtained by embedding a coil conductor in an element body made of a magnetic material. In a coil component of this type, an element body is made of a magnetic material, so that most of the magnetic flux generated by making current flow in a coil conductor can be confined inside the element body. However, a part of the magnetic flux leaks outside the element body, which may degrade magnetic characteristics or may adversely affect other electronic components adjacent to the coil component.

To cope with such a problem, Japanese Patent Application Laid-open No. 2013-045848 and Japanese Utility Model Application Laid-open No. H02-067609 disclose a coil component in which a magnetic film is formed on the surface of the element body. In the coil component described in the above publications, a magnetic film is formed on the upper and lower surfaces perpendicular to the coil axis.

However, in the coil component described in the above publications, a large eddy current is generated in the magnetic film with a change in the magnetic flux, resulting in a large eddy current loss. Further, in this coil component, each of the upper and lower surfaces having a high magnetic flux density is covered with a single magnetic film, so that the magnetic film is easily magnetically saturated. Furthermore, in this coil component, spread of the magnetic flux in the side surface direction of the coil component is not sufficiently suppressed, so that when the coil component is mounted on a printed circuit board in a high density, other electronic components adjacent thereto may be affected by leakage magnetic flux.

SUMMARY

It is therefore an object of the present invention to provide a coil component suitable for high density mounting by reducing leakage magnetic flux while suppressing an eddy current loss and magnetic saturation and by suppressing the spread of magnetic flux in the side surface direction.

A coil component according to the present invention includes an element body made of a first magnetic material, a coil conductor embedded in the element body, and first and second magnetic films each made of a second magnetic material having higher permeability than that of the first magnetic material. The element body has an upper surface crossing the coil axis of the coil conductor and first and second side surfaces extending parallel to the coil axis. The first magnetic film is formed on the upper surface and first side surface of the element body, and the second magnetic film is formed on the upper surface and second side surface of the element body.

According to the present invention, the magnetic film formed on the upper surface having a high magnetic flux density is divided into a plurality of parts, so that an eddy current generated with a change in magnetic flux can be reduced, and magnetic saturation is made difficult to occur. In addition, each magnetic film covers the side surface of the element body, so that most of leakage magnetic flux circulates while passing through the magnetic film. As a result, spread of magnetic flux in the side surface direction is suppressed, enabling higher density mounting as compared with a conventional coil component.

In the present invention, the element body preferably further has a mounting surface positioned on the side opposite the upper surface, and the first and second magnetic films are preferably formed on the mounting surface of the element body as well. With this configuration, leakage magnetic flux can further be reduced, and the vertical directionality of the coil component can be eliminated.

The coil component according to the present invention preferably further includes a first terminal electrode connected to one end of the coil conductor and a second terminal electrode connected to the other end of the coil conductor. The element body preferably further has third and fourth side surfaces extending parallel to the coil axis and crossing at right angles the first and second side surfaces. The first terminal electrode is preferably formed on at least the third side surface, and the second terminal electrode is preferably formed on at least the fourth side surface. With the above configuration, the magnetic film can be formed without interference with the terminal electrode.

In the present invention, a part of the first magnetic film that is formed on the first side surface may be separated by a slit, and similarly, a part of the second magnetic film that is formed on the second side surface may be separated by a slit. This configuration makes the magnetic film more difficult to magnetically saturate, reducing an eddy current loss. In this case, the slit is preferably extended in the direction perpendicular to the coil axis and is more preferably offset to the mounting surface of the element body positioned on the side opposite the upper surface.

The coil component according to the present invention may further include a third magnetic film formed on the upper surface of the element body independent of the first and third magnetic films. This configuration further reduces leakage magnetic flux, making magnetic saturation less likely to occur.

As described above, according to the present invention, leakage magnetic flux can be reduced by the magnetic film. In addition, an eddy current loss and magnetic saturation can be suppressed by division of the magnetic film into a plurality of parts. Further, spread of magnetic flux in the side surface direction is suppressed, so that adverse effect on electronic components adjacent to the coil component can be reduced. This enables achievement of high density mounting on the printed circuit board.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

<First Embodiment>

Figure 1:
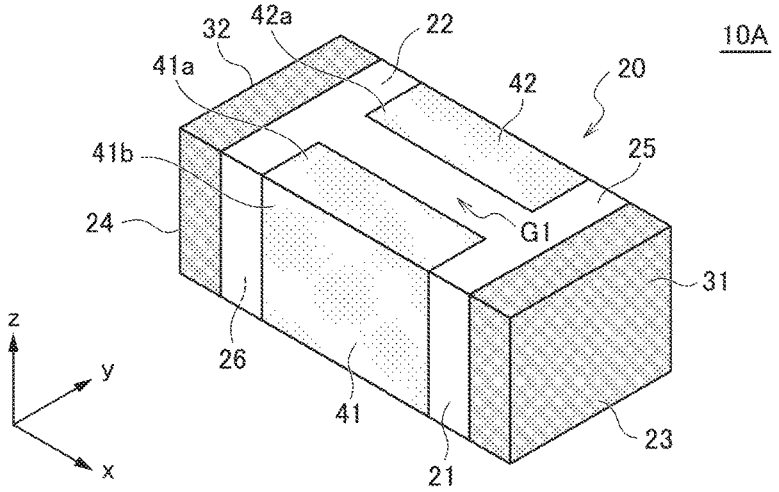
FIG. 1 is a schematic perspective view illustrating the outer appearance of a coil component according to a first embodiment of the present invention.
Figure 2:
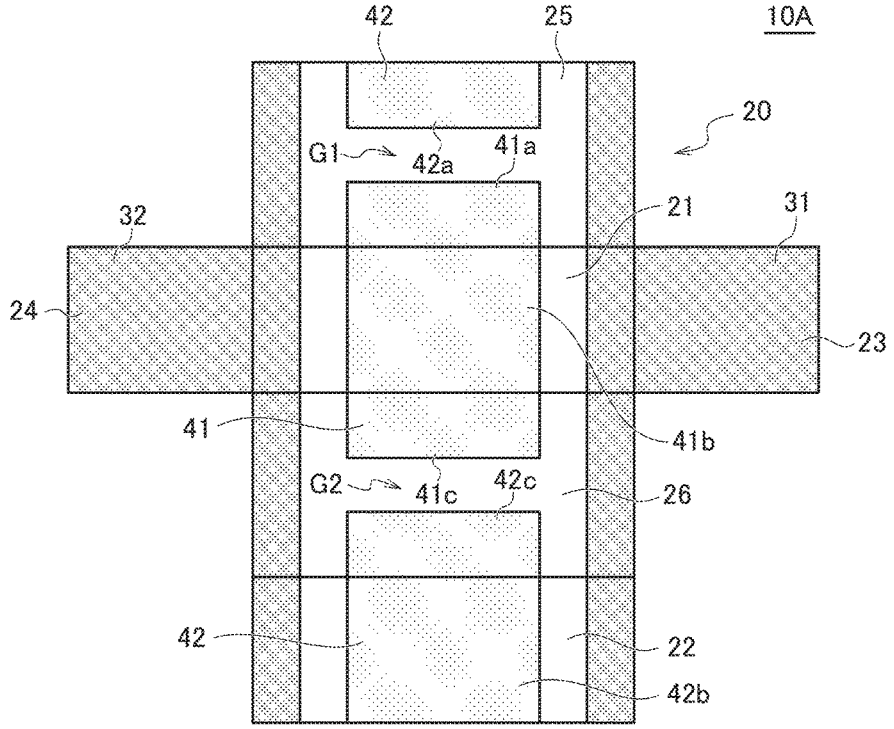
FIG. 2 is a development view for explaining the surface structure of the coil component shown in FIG. 1.
Figure 3:
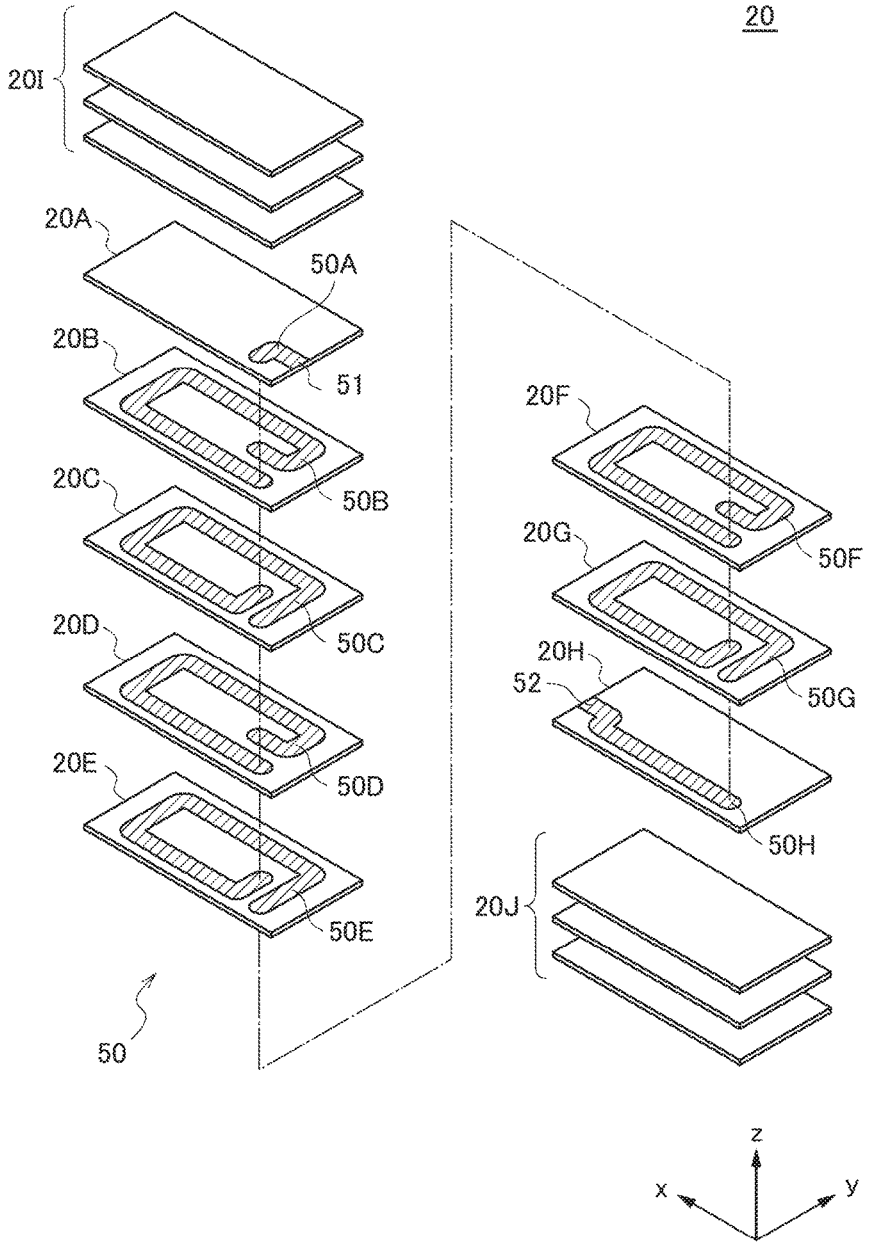
FIG. 3 is an exploded perspective view for explaining the internal structure of the coil component shown in FIG. 1.

FIG. 1 is a schematic perspective view illustrating the outer appearance of a coil component 10A according to the first embodiment of the present invention. FIG. 2 is a development view for explaining the surface structure of the coil component 10A. FIG. 3 is an exploded perspective view for explaining the internal structure of the coil component 10A.

As illustrated in FIGS. 1 and 2, the coil component 10A according to the present embodiment includes an element body 20 having a substantially rectangular parallelepiped shape, first and second terminal electrodes 31 and 32 formed on the surface of the element body 20, and first and second magnetic films 41 and 42 formed on the surface of the element body 20. Although not particularly limited, the coil component 10A according to the present embodiment is suitably used as a power supply inductor, in which a larger current than that in a coil component used as a signal inductor flows, so that a large number of magnetic fluxes is generated. Thus, the coil component 10A is a product particularly requiring reduction in leakage magnetic flux.

The element body 20 is a laminated sintered body of ceramic green sheets including a magnetic material such as ferrite (Ni—Cu—Zn-based ferrite, Ni—Cu—Zn—Mg-based ferrite, Cu—Zn-based ferrite, or Ni—Cu-based ferrite). The permeability of the element body 20 is about 20 to about 200.

As illustrated in FIG. 3, in the present embodiment, the element body 20 is constituted of a plurality of insulating layers 20A to 20J each having the xy plane. The insulating layers 20A to 20J have the same planar shape. Of the insulating layers 20A to 20J, the insulating layers 20A to 20H have loop-shaped conductor patterns 50A to 50H constituting a coil conductor 50, respectively, on their surfaces. The conductor patterns 50A to 50H are each a sintered body of a conductive paste including a conductive material (e.g., Ag powder or Pd powder). A plurality of insulating layers 20I each having no conductor pattern are disposed above the insulating layer 20A, and a plurality of insulating layers 20J each having no conductor pattern are disposed below the insulating layer 20H.

The conductor patterns 50A to 50H are connected to each other through a through hole conductor penetrating the insulating layers 20A to 20G to thereby form one coil conductor 50. One end 51 of the coil conductor 50 is formed by the conductor pattern 50A and drawn out to one side of the element body 20 in the x-direction to be connected to the first terminal electrode 31. The other end 52 of the coil conductor 50 is formed by the conductor pattern 50H and drawn out to the other side of the element body 20 in the x-direction to be connected to the second terminal electrode 32. The coil axis of the coil conductor 50 extends in the z-direction.

The number of insulating layers 20A to 20J and the shape of the conductor pattern 50A shown in FIG. 3 are for illustrative purposes only, and the present invention is not limited to these examples. For example, although the number of turns of the coil conductor 50 is 6.5 in the present embodiment, the number is not limited thereto, but may be designed appropriately depending on characteristics required. Further, in the present invention, the element body 20 need not necessarily be the laminated sintered body of ferrite, and may be made of a composite magnetic material obtained by mixing magnetic powder and binder resin. Further, the coil conductor 50 need not necessarily be formed of a combination of conductor patterns, and may be formed by winding a coated conducting wire.

As illustrated in FIGS. 1 and 2, the element body 20 has first to fourth side surfaces 21 to 24 extending parallel to the coil axis (z-direction), an upper surface 25, and a mounting surface 26. The upper surface 25 and mounting surface 26 extends perpendicular to the coil axis (z-direction). The first and second side surfaces 21 and 22 each constitute the xz plane and are positioned on the sides opposite each other. The third and fourth side surfaces 23 and 24 each constitute the yz plane and are positioned on the sides opposite each other. The upper surface 25 and mounting surface 26 each constitute the xy plane and are positioned on the sides opposite each other. The mounting surface 26 is the surface that faces a printed circuit board when the coil component 10A is mounted on the printed circuit board; however, the coil component 10A according to the present embodiment has no directionality in the vertical direction (z-direction), so that the coil component 10A may be mounted with the upper surface 25 and mounting surface 26 reversed, that is, with the upper surface 25 facing the printed circuit board.

The third side surface 23 is entirely covered with the first terminal electrode 31. A part of the first terminal electrode 31 is also formed on the first and second side surfaces 21 and 22, upper surface 25, and mounting surface 26. The fourth side surface 24 is entirely covered with the second terminal electrode 32. A part of the second terminal electrode 32 is also formed on the first and second side surfaces 21 and 22, upper surface 25, and mounting surface 26. However, the coil component 10A according to the present embodiment has no directionality in the left-right direction (x-direction), so that the first terminal electrode 31 and the second terminal electrode 32 may be reversed.

The coil component 10A according to the present embodiment further includes the first and second magnetic films 41 and 42. The first and second magnetic films 41 and 42 are each made of a magnetic material having permeability higher than that of the magnetic material constituting the element body 20. The permeability of the first and second magnetic films 41 and 42 is preferably 10 times or more, e.g., about 50 times as high as the permeability of the element body 20. Specifically, the permeability is preferably about 1000 to 10000. Examples of the material of the first and second magnetic films 41 and 42 include permalloy (Fe—Ni alloy), super permalloy (Fe—Ni—Mo alloy), sendust (Fe—Si—Al alloy), Fe—Si alloy, Fe—Co alloy, Fe—Cr alloy, Fe—Cr—Si alloy, and Fe.

The film thickness of the first and second magnetic films 41 and 42 is set as small as possible in a range capable of ensuring sufficient magnetic characteristics. For example, the film thickness is preferably set to about 0.5 μm to about 5 μm. As a method of forming the first and second magnetic films 41 and 42, a thin-film formation such as a sputtering method or a vapor deposition method is preferably used.

As illustrated in FIGS. 1 and 2, the first magnetic film 41 includes a part 41*a* covering the upper surface 25, a part 41*b* covering the first side surface 21, and a part 41*c* covering the mounting surface 26 which are continuously formed. Similarly, the second magnetic film 42 includes a part 42*a* covering the upper surface 25, a part 42*b* covering the second side surface 22, and a part 42*c* covering the mounting surface 26 which are continuously formed.

The first magnetic film 41 and the second magnetic film 42 are not in contact with each other and therefore separated from each other on the upper surface 25 and mounting surface 26. That is, on the upper surface 25, a gap G1 is provided between the first and second magnetic films 41 and 42, whereby the first and second magnetic films 41 and 42 are separated from each other without any contact with each other. Similarly, on the mounting surface 26, a gap G2 is provided between the first and second magnetic films 41 and 42, whereby the first and second magnetic films 41 and 42 are separated from each other without any contact with each other. Needless to say, the first and second magnetic films 41 and 42 and the first and second terminal electrodes 31 and 32 are separated from each other without any contact being made among them.

The first and second magnetic films 41 and 42 each function as a magnetic path of magnetic flux generated when current is made to flow in the coil conductor 50 and, particularly, play a role of confining leakage magnetic flux to be radiated outside within the element body 20. The leakage magnetic flux circulates mainly from the upper surface 25 toward the mounting surface 26 (or vice versa) and, in the present embodiment, most of the leakage magnetic flux passes through the first and second magnetic films 41 and 42. This allows spread of the leakage magnetic flux particularly in the side surface direction (y-direction) to be significantly suppressed. Thus, when the coil component 10A is mounted on the printed circuit board, adverse effect of the leakage magnetic flux on electronic components adjacent to the coil component 10A can be reduced, so that it is possible to reduce the distance from the adjacent electronic components in the y-direction as compared with conventional approaches. Therefore, it is possible to achieve higher density mounting.

Further, in the present embodiment, the first and second magnetic films 41 and 42 are separated from each other on the upper surface 25 and the mounting surface 26 each of which has a high magnetic flux density, so that generation of an eddy current can be suppressed more than a case where a single magnetic film is formed on the upper surface 25 and mounting surface 26. In addition, the configuration in which the first and second magnetic films 41 and 42 are separated from each other on the upper surface 25 and mounting surface 26 makes it difficult for the first and second magnetic films 41 and 42 to be magnetically saturated, so that even when the coil component 10A is used as a power inductor in which a large current flows, magnetic saturation does not occur, and the spreading of the leakage magnetic flux can be suppressed effectively.

<Second Embodiment>

Figure 4:
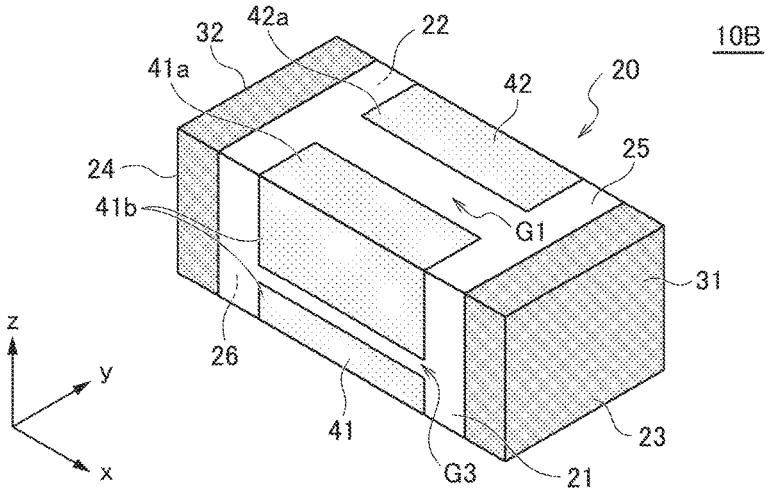
FIG. 4 is a schematic perspective view illustrating the outer appearance of a coil component according to a second embodiment of the present invention.
Figure 5:
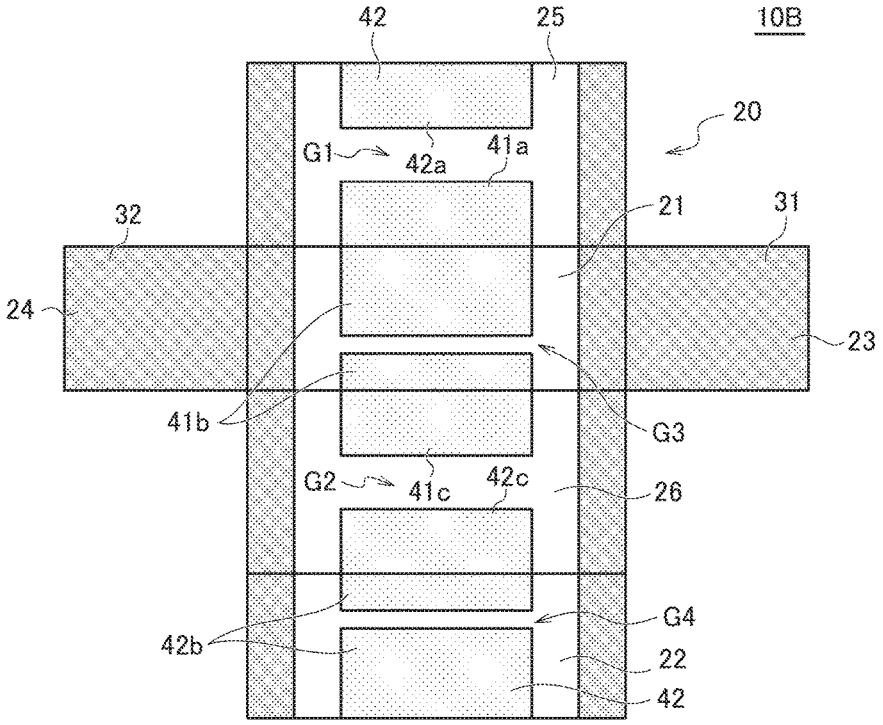
FIG. 5 is a development view for explaining the surface structure of the coil component shown in FIG. 4.

FIG. 4 is a schematic perspective view illustrating the outer appearance of a coil component 10B according to the second embodiment of the present invention. FIG. 5 is a development view for explaining the surface structure of the coil component 10B.

As illustrated in FIGS. 4 and 5, the coil component 10B according to the present embodiment differs from the coil component 10A according to the first embodiment in that slits G3 and G4 are formed in the first and second magnetic films 41 and 42, respectively. Other configurations are the same as those of the coil component 10A according to the first embodiment, so the same reference numerals are given to the same elements, and overlapping description will be omitted.

The slit G3 is formed in the part 41*b* of the first magnetic film 41 that covers the first side surface 21 and extends in the x-direction so as to separate the part 41*b* in the z-direction. Similarly, the slit G4 is formed in the part 42*b* of the second magnetic film 42 that covers the second side surface 22 and extends in the x-direction so as to separate the part 42*b* in the z-direction. As a result, the slits G3 and G4 each function as a magnetic gap, making it more difficult for the first and second magnetic films 41 and 42 to be saturated and allowing an eddy current loss to be reduced.

Further, in the present embodiment, the slits G3 and G4 are offset to the mounting surface 26 side, so that the magnetic flux leaking from the slits G3 and G4 is positioned in the vicinity of the surface of the printed circuit board. As a result, adverse effect of the leakage magnetic flux on electronic components adjacent to the coil component 10B can be minimized.

<Third Embodiment>

Figure 6:
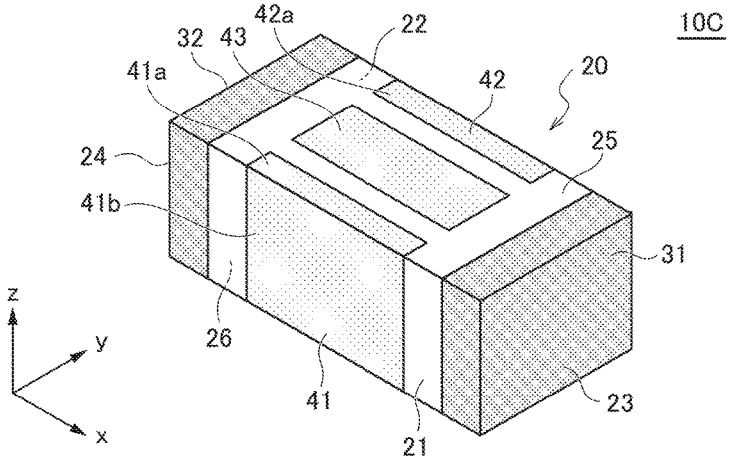
FIG. 6 is a schematic perspective view illustrating the outer appearance of a coil component according to a third embodiment of the present invention.
Figure 7:
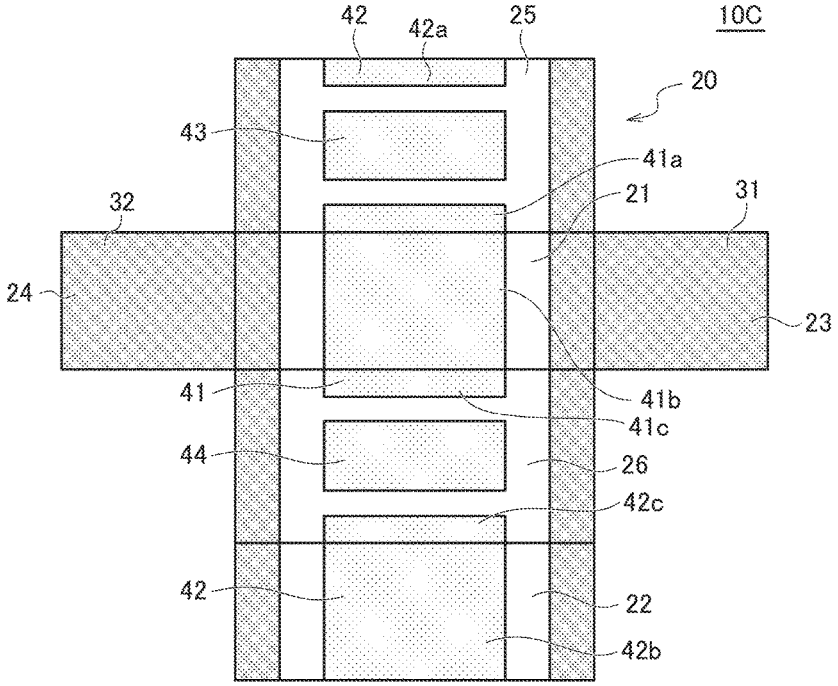
FIG. 7 is a development view for explaining the surface structure of the coil component shown in FIG. 6.

FIG. 6 is a schematic perspective view illustrating the outer appearance of a coil component 10C according to the third embodiment of the present invention. FIG. 7 is a development view for explaining the surface structure of the coil component 10C.

As illustrated in FIGS. 6 and 7, the coil component 10C according to the present embodiment differs from the coil component 10A according to the first embodiment in that third and fourth magnetic films 43 and 44 are additionally formed. Other configurations are the same as those of the coil component 10A according to the first embodiment, so the same reference numerals are given to the same elements, and overlapping description will be omitted.

The third magnetic film 43 is formed on the upper surface 25 of the element body 20 independent of the first and second magnetic films 41 and 42. Similarly, the fourth magnetic film 44 is formed on the mounting surface 26 of the element body 20 independent of the first and second magnetic films 41 and 42. The third and fourth magnetic films 43 and 44 are located at the same positions in terms of the xy direction and are each disposed in a substantially center portion of the upper surface 25 or mounting surface 26 so as to cover at least a part of the inner diameter portion of the coil conductor 50 in a plan view (as viewed in the z-direction).

The coil component 10C according to the present embodiment further includes the third and fourth magnetic films 43 and 44 and thus can shield the leakage magnetic flux more effectively. In addition, the magnetic film is divided into three parts on the upper surface 25 and mounting surface 26 of the element body 20, allowing an eddy current to be further reduced and making magnetic saturation difficult to occur.

<Fourth Embodiment>

Figure 8:
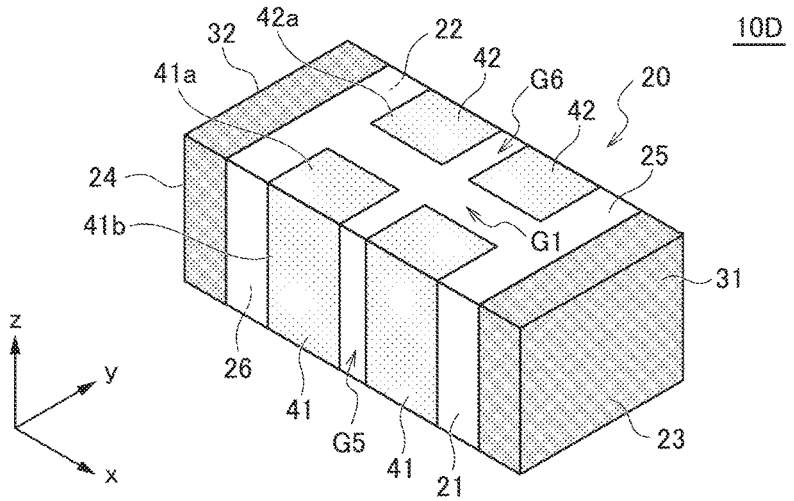
FIG. 8 is a schematic perspective view illustrating the outer appearance of a coil component according to a fourth embodiment of the present invention.
Figure 9:
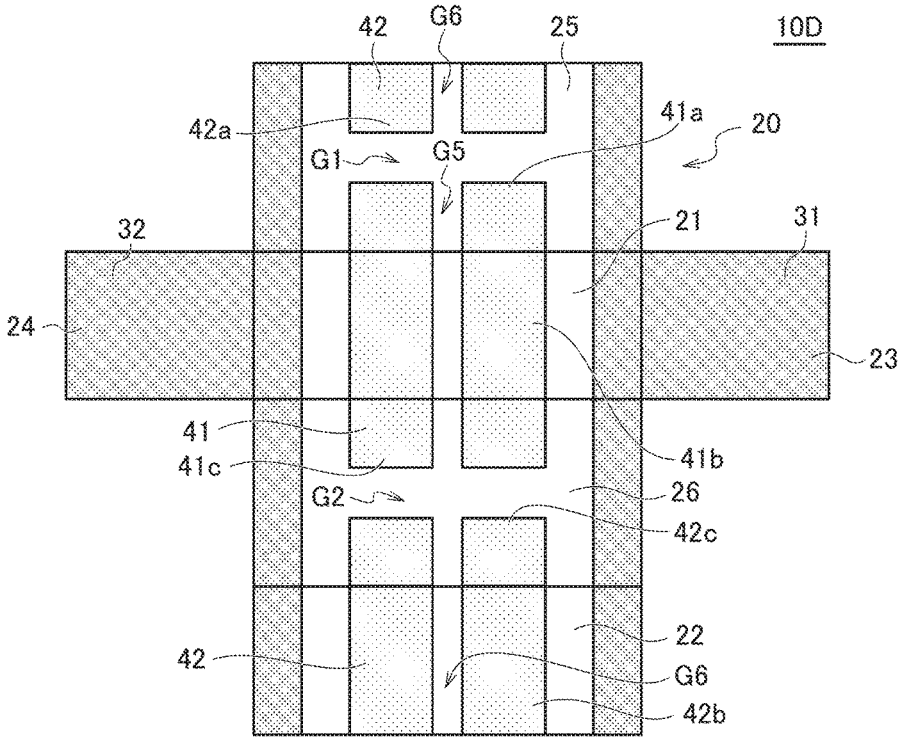
FIG. 9 is a development view for explaining the surface structure of the coil component shown in FIG. 8.

FIG. 8 is a schematic perspective view illustrating the outer appearance of a coil component 10D according to the fourth embodiment of the present invention. FIG. 9 is a development view for explaining the surface structure of the coil component 10D.

As illustrated in FIGS. 8 and 9, the coil component 10D according to the present embodiment differs from the coil component 10A according to the first embodiment in that slits G5 and G6 are formed in the first and second magnetic films 41 and 42, respectively. Other configurations are the same as those of the coil component 10A according to the first embodiment, so the same reference numerals are given to the same elements, and overlapping description will be omitted.

The slit G5 is formed over the parts 41*a* to 41*c* so as to divide the first magnetic film 41 in the x-direction. Similarly, the slit G6 is formed over the parts 42*a* to 42*c* so as to divide the second magnetic film 42 in the x-direction. It follows that the slits G5 and G6 extend in the z-direction on the respective first and second side surfaces 21 and 22 and extend in the y-direction on the upper surface 25 and mounting surface 26.

In the present embodiment, the magnetic film is divided into four parts on the upper surface 25 and mounting surface 26 of the element body 20, allowing an eddy current to be further reduced and making magnetic saturation difficult to occur.

It is apparent that the present invention is not limited to the above embodiments, but may be modified and changed without departing from the scope and spirit of the invention.

For example, although the first and second magnetic films 41 and 42 are formed on the mounting surface 26 in the above embodiments, the magnetic film need not necessarily be formed on the mounting surface 26 and may be omitted.

What is claimed is:

1. A coil component comprising:

an element body made of a first magnetic material;

a coil conductor embedded in the element body; and first and second magnetic films made of a second magnetic material having higher permeability than that of the first magnetic material, wherein the element body has an upper surface crossing a coil axis of the coil conductor and first and second side surfaces extending substantially parallel to the coil axis, and wherein the first magnetic film is formed on the upper surface and first side surface of the element body, and the second magnetic film is formed on the upper surface and second side surface of the element body.

2. The coil component as claimed in claim 1, wherein the element body further has a mounting surface opposite to the upper surface, and wherein the first and second magnetic films are further formed on the mounting surface of the element body.

3. The coil component as claimed in claim 1, further comprising a first terminal electrode connected to one end of the coil conductor and a second terminal electrode connected to other end of the coil conductor, wherein the element body further has third and fourth side surfaces extending substantially parallel to the coil axis and crossing at substantially right angles to the first and second side surfaces, and wherein the first terminal electrode is formed on at least the third side surface, and the second terminal electrode is formed on at least the fourth side surface.

4. The coil component as claimed in claim 1, wherein a part of the first magnetic film that is formed on the first side surface is separated by a first slit, and a part of the second magnetic film that is formed on the second side surface is separated by a second slit.

5. The coil component as claimed in claim 4, wherein each of the first and second slits is extended in substantially perpendicular to the coil axis.

6. The coil component as claimed in claim 5, wherein each of the first and second slits is offset to a mounting surface of the element body positioned opposite to the upper surface.

7. The coil component as claimed in claim 1, further comprising a third magnetic film formed on the upper surface of the element body independent of the first and third magnetic films.

8. The coil component as claimed in claim 1, wherein the upper surface of the element body includes first, second and third sections, wherein the first magnetic film is formed on the first section of the upper surface, wherein the second magnetic film is formed on the second section of the upper surface, and wherein the upper surface of the element body is exposed at the third section so that the third section of the upper surface is free from the first and second magnetic films.

9. A coil component comprising:

an element body having first and second surfaces opposite to each other and third and fourth surfaces opposite to each other, and fifth and sixth surfaces opposite to each other;

a coil conductor embedded in the element body;

a first magnetic film formed on the first surface and the fifth surface;

a second magnetic film formed on the second surface and the fifth surface;

a first terminal electrode connected to one end of the coil conductor, the first terminal electrode being formed on the third surface; and a second terminal electrode connected to other end of the coil conductor, the second terminal electrode being formed on the fourth surface.

10. The coil component as claimed in claim 9, further comprising a third magnetic film formed on the fifth surface.

11. The coil component as claimed in claim 9, wherein the first and second magnetic films are further formed on the sixth surface.

12. The coil component as claimed in claim 9, wherein the third and fourth surfaces are free from the first and second magnetic films.

13. The coil component as claimed in claim 9, wherein the first magnetic film is divided into first and second sections by a first slit formed on the first surface, and wherein the second magnetic film is divided into third and fourth sections by a second slit formed on the second surface.

14. The coil component as claimed in claim 13, wherein the first section is greater than the second section, and the third section is greater than the fourth section.

15. The coil component as claimed in claim 9, wherein the coil conductor has a coil axis that is substantially parallel to the first to fourth surfaces.

16. The coil component as claimed in claim 9, wherein the fifth surface of the element body includes first, second and third sections, wherein the first magnetic film is formed on the first section of the fifth surface, wherein the second magnetic film is formed on the second section of the fifth surface, and wherein the fifth surface of the element body is exposed at the third section so that the third section of the upper surface is free from the first and second magnetic films.

17. A coil component comprising:

an element body having a first surface, the first surface including first to fifth sections;

a coil conductor embedded in the element body, the coil conductor having a coil axis that is substantially perpendicular to the first surface;

a first magnetic film formed on the first section of the first surface;

a second magnetic film formed on the second section of the first surface;

a first terminal electrode connected to one end of the coil conductor, the first terminal electrode being formed on the third section of the first surface; and a second terminal electrode connected to other end of the coil conductor, the second terminal electrode being formed on the fourth section of the first surface, wherein the first surface of the element body is exposed at the fifth section so that the fifth section of the first surface is free from the first and second magnetic films and the first and second terminal electrodes so as to separate the first and second magnetic films and the first and second terminal electrodes from one another.

18. The coil component as claimed in claim 17, wherein the first surface further includes a sixth section surrounded by the fifth section, and wherein the coil component further comprises a third magnetic film formed on the sixth section of the first surface.

19. The coil component as claimed in claim 17, wherein the element body further has second and third surfaces opposite to each other, wherein the first magnetic film is further formed on the second surface, and wherein the second magnetic film is further formed on the third surface.

* * * * *